US009963811B2

(12) United States Patent
Herzog

(10) Patent No.: US 9,963,811 B2
(45) Date of Patent: May 8, 2018

(54) DEVICE FOR SEPARATING NEEDLES

(71) Applicant: AUTEFA SOLUTIONS GERMANY GMBH, Friedberg (DE)

(72) Inventor: Guido Herzog, Rheineck (CH)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 40 days.

(21) Appl. No.: 14/895,725

(22) PCT Filed: Jun. 2, 2014

(86) PCT No.: PCT/EP2014/061359
§ 371 (c)(1),
(2) Date: Dec. 3, 2015

(87) PCT Pub. No.: WO2014/195260
PCT Pub. Date: Dec. 11, 2014

(65) Prior Publication Data

US 2016/0122926 A1 May 5, 2016

(30) Foreign Application Priority Data

Jun. 4, 2013 (DE) ..... 10 2013 009 267

(51) Int. Cl.
*D04H 18/02* (2012.01)

(52) U.S. Cl.
CPC ..... *D04H 18/02* (2013.01)

(58) Field of Classification Search
CPC .. D04H 18/02; D04H 18/00; Y10T 29/53478; Y10T 29/49895; Y10T 29/53; B25C 1/005; B23P 19/001; B23P 19/002; B23P 19/004; B23P 19/006; B23P 19/007; B23P 19/04; B23P 19/10; B23P 19/107; B23P 19/12
USPC ..... 28/107, 115; 227/120, 124, 127, 129, 227/135
See application file for complete search history.

(56) References Cited

U.S. PATENT DOCUMENTS 1,485,413 A 3/1924 Johanson
2,866,201 A * 12/1958 Clarke ..... H05K 13/0452 227/120
4,122,975 A 10/1978 Lowery et al.
(Continued)

FOREIGN PATENT DOCUMENTS

DE 32 01 282 A1 7/1983
DE 83 29 050 U1 1/1984
(Continued)

OTHER PUBLICATIONS

English language machine translation of DE 8329050, Singer, dated Jun. 1985, translation of specification and claims, 17 pages.*
(Continued)

*Primary Examiner* — Amy Vanatta
(74) *Attorney, Agent, or Firm* — McGlew and Tuttle, P.C.

(57) ABSTRACT

A device for separating needles (1) includes a receiving element (2) for needles (1) and a separating device (3). The receiving element (2) includes at least one through opening (4). The separating device (3) includes an ejection device (5) which can be passed through the through-opening (4) of the receiving element (2). The ejection device (5) has a contact area (6) on the upper edge which corresponds at least to a needle (1) and detects the needle.

25 Claims, 9 Drawing Sheets

(56) References Cited

U.S. PATENT DOCUMENTS

| | | | | |
|---|---|---|---|---|
| 4,568,010 | A | 2/1986 | Dilo | |
| 4,936,497 | A | 6/1990 | Ordelt | |
| 5,291,652 | A * | 3/1994 | Vossen | B26D 7/1818 227/128 |
| 5,509,185 | A * | 4/1996 | Petkov | B23P 19/04 29/252 |
| 6,393,693 | B1 * | 5/2002 | Finocchi | E04H 18/00 29/244 |
| 2008/0184546 | A1 * | 8/2008 | Munster | D04H 18/02 29/428 |
| 2010/0162543 | A1 * | 7/2010 | Dilo | D04H 18/00 28/115 |
| 2010/0242266 | A1 * | 9/2010 | Munster | D04H 18/00 29/700 |
| 2014/0026379 | A1 * | 1/2014 | Herzog | D04H 18/02 28/115 |

FOREIGN PATENT DOCUMENTS

| | | | |
|---|---|---|---|
| DE | 85 12 596 | U1 | 6/1985 |
| DE | 39 41 159 | C2 | 9/1991 |
| DE | 10 2011 016 755 | B3 | 10/2012 |
| EP | 1 953 287 | A1 | 8/2008 |
| JP | H113 50 328 | A | 12/1999 |

OTHER PUBLICATIONS

English language Abstract of DE 3941159, dated Sep. 1991, Ordelt, 2 pages.*

* cited by examiner

FIG. 2
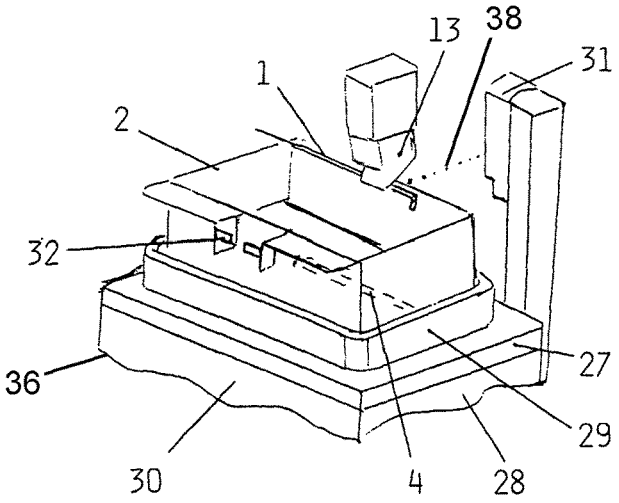
FIG. 3
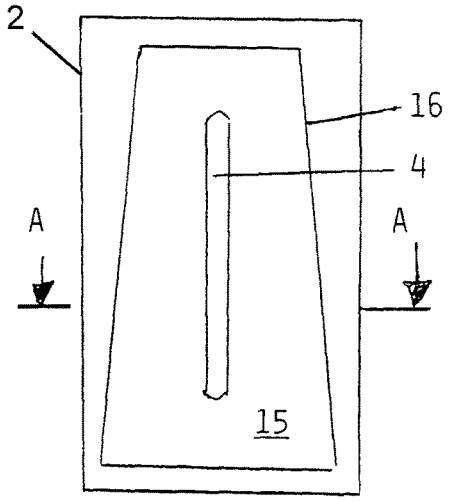
FIG. 4 A-A
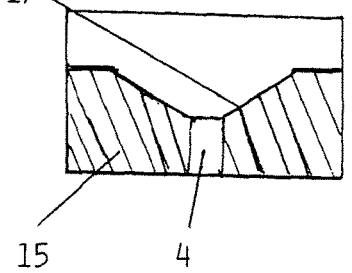
FIG. 5
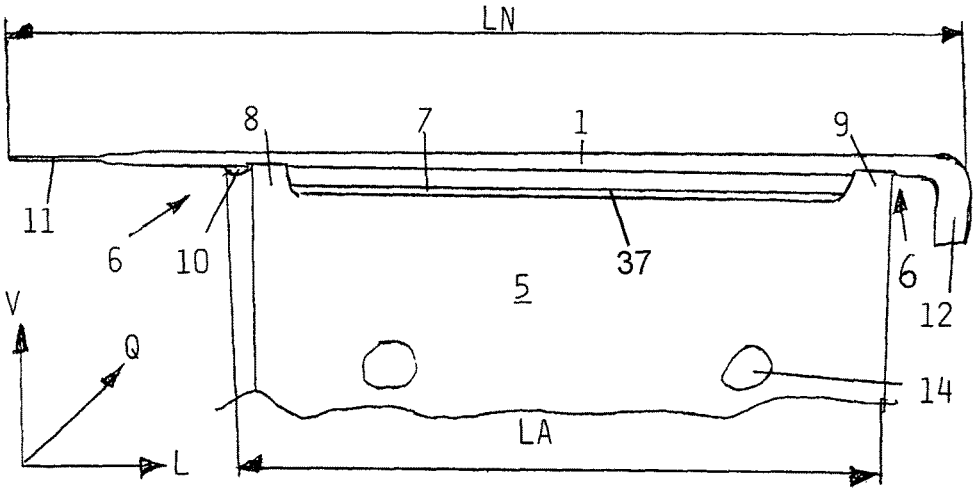

DEVICE FOR SEPARATING NEEDLES

CROSS REFERENCE TO RELATED APPLICATIONS

This application is a United States National Phase Application of International Application PCT/EP2014/061359 filed Jun. 2, 2014 and claims the benefit of priority under 35 U.S.C. § 119 of German Patent Application 10 2013 009 267.1 filed Jun. 4, 2013 the entire contents of which are incorporated herein by reference.

FIELD OF THE INVENTION

The present invention pertains to a device for separating needles, and in particular for the fitting of a needle board of a needle machine for the manufacture of nonwoven fabric or needle felt, with a receiving element for the needles and with a separating device.

BACKGROUND OF THE INVENTION

Needle boards are components of needle machines for manufacture of nonwoven fabric or needle felt and are fitted with special needles. The needle machines are used for strengthening/thickening of fibrous materials, fibers and continuous filaments. Products such as spunbond, artificial leather, artificial suede, and needle felt which can contain nonwoven fabric are manufactured. The needles have an L shape due to their fastening hooks, the so-called crutch or crank, and are passed through drilled holes in the needle board and fixed. The needles are subject to major stress and damaged over time.

Besides needles with crutches or cranks, there are also needles with fastening areas, which are formed by the thickening of an end, as is well known, e.g., from JP 11350328 A or DE 10 2011 016 755 B3. The present invention may refer both to the separation of needles, which are used for fitting a needle board, and to needles, such as sewing needles or embroidering needles or knitting needles, nails or nail-like pins in other areas of application.

So that now the needle board can be fitted with the needles, these needles must be removed from a removal site. The removal site is known from the state of the art in very different embodiments.

For example, an oscillating conveyor, which is arranged in a carriage unit of a needle-loading and needle-unloading device and has a receiving element for a supply of primarily unorganized needles appears from DE 3941159 C1. The oscillating conveyor has an outlet, in which the needles are separated and oriented with their crutches or cranks in the same direction. The separated needles oriented in the same direction are then placed at right angles on a belt-like linear conveyor, which advances each time by one step by means of a stepper drive when a new needle shall be driven into the needle board. A gripper grasps the last corresponding needle of the needles fed with the belt conveyor and then pivots to the needle board to carry out the fitting. The separation of the needles to be provided requires two conveying units—an oscillating conveyor and a belt conveyor—and thus is relatively costly. In addition, the prior-art separating device needs a lot of space within the overall device.

Another device for separating and feeding needles, with which a needle board shall be fitted, is well known from EP 1953287 A1. The needle feed comprises a receiving element for the needles in the form of a filling funnel with a vibration device and with a filling device in the form of two parallel threaded spindles, rotating in the same direction, in the motions of which the needles are separated at a desired distance and are placed in groups, such that they can be grasped and picked up by a gripping jaw/multiple gripping jaw. Stepping motors are used for rotating the spindles. The separating device in question requires a high design effort and takes up a lot of space.

DE 10 2011 016 755 B3 shows a device, which, besides other functions, is also used to fit a needle board with needles, and a robot with a tool arm picks up fresh needles from a removal site. Since the robot is equipped with an articulated tool arm and tool, it can remove needles even from a removal site, which is the reason why the labor cost is extremely low. The robot has a high freedom of movement, which allows the free needle pickup selectively, in relation to a selected needle in the removal site. Due to the articulated tool arm at the robot, the design effort of a conventional needle feed is avoided. The removal site is, e.g., arranged on a base plate of the robot. During this needle removal, the removal is preceded by a detection operation by means of a camera or a laser scanner or additional detection devices. The data are electronically collected and processed in a separate computer, such that the position of the needle to be picked up is determined and then the orientation of the tool arm with the gripper takes place. This solution of a robot operating by means of image detection is "binpicking." This type of needle removal is very costly, since the robot has to detect a high-resolution image of the needle. A high-resolution image detection is very costly and requires a costly software. Many programming hours and tests are necessary to calculate the undefined gripping position and the gripping location of the needle to be grasped at the removal site. The gripping position describes where the crutch or crank/hook must be arranged. The gripping location depends on the position of the needle in the removal site. The needle detection and needle grasping take place relatively slowly in the state of the art in question. Approx. 5 seconds pass by from the detection of the image until the picking up of the needle. The computerized selection of a needle, the going there and grasping have, moreover, a hit ratio of approx. 85%, which is in need of improvement. The seconds needed to grasp the needle play a very large role in the goal of fitting a needle board with, for example, approx. 50,000 needles.

SUMMARY OF THE INVENTION

Based on the state of the art, a basic object of the present invention is to provide a cost-effective device for separating needles, which brings a needle into a defined position quickly and reliably, such that a reproducible, accurate grasping of the needle is made possible by a needle fitting (insertion) device (insertion device). In addition, the device shall be able to be embodied in a slimmer size.

The above object is accomplished by a device for separating or selecting needles, in particular for the a fitting of a needle board of a needle machine for the manufacture of nonwoven fabric or needle felt. The device comprises a needle mass (pile/bunch) receiving element for receiving a mass or pile or bunch of needles and a separating device. According to this, a device of the type in question is designed, such that the receiving element has at least one through opening, that the separating device comprises an ejection device, which can be passed through the through opening of the receiving element and which has a contact area that corresponds at least to one needle of the needle mass (pile/bunch).

First, it has been recognized that the state of the art provides for two fundamental types of devices for separating. On the one hand, a separate separating device is known, which is composed of two components, i.e., a needle receiving element with a kinematic oscillating or vibrating mechanism, and a separating device in the form of a conveyor. From the receiving element, the needles reach the conveyor, from where the fitting (insertion) device receives the needles. A lot of space is required because of the size in this case. On the other hand, a separating device is known, which is integrated into the needle fitting (insertion) device in the form of a robot, which then needs an image processing software, which is complicated, slow and, in addition, costly and suboptimal in terms of hit ratio, for the detection of the needle before the grasping.

With regard to the one prior-art type of construction, it has been recognized that the size of a conventional separating device can be reduced when the separating operation does not take place first at the time of discharge of the needle from the receiving element, but rather quasi takes place in the receiving element itself.

With regard to the other prior-art type of construction, it has been recognized that image processing software, e.g., in a fitting (insertion) device in the form of a robot, is then not necessary for the purpose of the needle removal when the separating device positions the needle in a reproducible manner.

According to the present invention, it has been recognized that the positioning of a needle can be achieved by means of a device of this class even with a smaller size when the separating operation and the presentation of the separated needle do not take place spatially separate from the filling location or from the receiving element, but rather the receiving element for the needles is the site of action of the separating device. The separating device penetrates into the area of the receiving element, and separates the needle through it. Thus, the inventive quality already lies in the fact that the receiving element is a component of the separating device during the separating operation.

Further, it has been recognized according to the present invention that the receiving element makes possible the separation of the needle, when it has at least one through opening, through which an ejection device of the separating device can be passed. Further, it has been recognized according to the present invention that a defined position of the needle can be reached when the ejection device has a contact area which is coordinated to the at least one needle and corresponds to this needle.

The ejection device of the device according to the present invention could be designed as a blade, punch or plunger. The ejection device could be passed through the receiving element and the needles there for ejecting the needle or even a desired number of needles in various directions. When the ejection device separates the needle, it pushes through the remaining pile (mass, bunch) of needles and thereby displaces the needles not grasped by the contact area. With regard to a slim design, it is preferred to arrange the ejection device below the receiving element. An embodiment with a blade, punch or plunger makes possible very small designs, such that a plurality of separating devices could also be provided next to one another—e.g., on the same base plate, on which a robot is located as a fitting (insertion) device—for different needles. In this way, it is possible to work with a plurality of needle types in various receiving elements and various ejection devices at the same time. Stops could be provided at the ejection device for vertical adjustment and for adjusting the path of extension.

For achieving a defined position of the needle, the contact area of the ejection device could comprise at least one groove for a needle. The contact area could also have a plurality of grooves or channels or depressions or the like for groupwise grasping of a plurality of needles by the fitting (insertion) device. The grooves of the multi-contact contact area could, moreover, also be adapted to the shape of various needles with different crutches or cranks and/or different needle dimensions and/or to the shape of needles without crutches or cranks. Corresponding thereto, the receiving element could comprise various chambers for different types of needles and through openings for the individual chambers and ejection devices, respectively, with the corresponding contact areas.

The groove at the contact area may have a different design. It may be changed during the ejection operation and during the separation. At the beginning of the separation, when the ejection device dips into the pile (mass, bunch) of needles, a groove, which is long and preferably continuous over the entire length of the ejection device, may be present. A single needle can especially easily be caught and positioned on the long groove.

In the extended operating position of the ejection device, it is favorable when, at said contact area, the groove is interrupted and a free space is formed, which facilitates the access of a gripping element for picking up and further transporting the separated needle. This different groove design can preferably be automatically set, and the displacement in question is derived from the extension movement of the ejection device via an actuator.

In terms of construction, the ejection device may have local and upwardly projecting supports at the axial ends of the contact area with a short groove on the top side, and a movable and correspondingly adjustable, as mentioned above, insert is arranged in the preferably hollow ejection device. This insert is located between said supports and likewise has a groove at the upper end. In the resting position and in the initial phase of the ejection and separation operation, the groove of the insert connects flush to the grooves of the supports. In the raised operating position, the insert is retracted, especially lowered, forming the free space.

According to the preferred embodiment, in which the ejection device is arranged below the receiving element, only a single through opening would then be necessary in the base plate of the receiving element when the receiving element is opening upwards. The upwards open receiving element is advantageous under the aspect of the displacement of needles which are not detected by the contact area of the ejection device. The receiving element could be embodied in other designs as well. For example, a receiving element with additional cover plate as protection against contamination is also possible. The formation of two opposite through openings which could be worked into the base plate and into the cover plate of the receiving element in an opposing manner would then be conceivable. However, it would also be possible to provide two opposing through openings at the side walls of the receiving element. This might then be the case when the gripping devices of the fitting (insertion) device can better grasp the selected needle in a lateral discharge position. The holding of the needle in the contact area could—precisely in the discharge position, i.e., when the contact area of the separating device leaves the receiving element—be generated by a temporary magnetic field, which must, of course, remain without effect on the other needles. The removal of needles below the receiving element would also be conceivable under this aspect.

The design of the receiving element for the needles is of importance essential to the present invention. It is set via this where the needles lie, where the ejection device of the separating device contacts and where, finally, the gripping devices of the fitting (insertion) device position themselves for picking up the needle. All of this takes place in a previously fixed area, such that—in contrast to DE 10 2011 016 755 B3—no position search takes place. The design of the receiving element is decisive, and manufacturing tolerances should be low. If needles with crutches or cranks are used, an upwards open receiving element with a depression having a trapezoid-shaped design could be provided, and the needle tips point to the converging end and the crutches or cranks point to the diverging end of the depression.

According to an advantageous embodiment, the receiving element could have a funnel-shaped design at least on the inside. The through opening could advantageously be arranged in the deepest point of the receiving element and, with regard to its dimensions, it could correspond to those of the contact area of the ejection device. In this advantageous embodiment of the device according to the present invention, the ejection device would be arranged below the receiving element or below the funnel opening/through opening.

A lifting device could be provided for moving the ejection device of the separating device. Said lifting device could have a drive, power transmission means, a guide and a carrier displaceable at the guide for the ejection device, and the displaceable carrier interacts with the power transmission means. A toothed rack and gear, which have a low friction loss, could be used to embody the power transmission means. However, a belt drive or a chain drive is also possible as power transmission means for the lifting device. The movement of the separating device could take place by means of an electrically, pneumatically, magnetically or hydraulically operating drive. Magnetic contacts could be provided and linear guide actions could be taken for the controlled movement of the ejection device. In an ejection device arranged below the receiving element, control commands such as "upwards/downwards/stop/go" could be executed.

So that an undesired discharge of needles during the resting position of the ejection device outside the receiving element is avoided, the contact area of the ejection device in the resting position could close the through opening of the receiving element. As an alternative or cumulatively, closures, which have a fin-like, diaphragm-like or even magnetic-type design, could be provided in opposing through openings. For example, closing parts lying in the through opening could be displaced and already bring about a preparatory separation of the needle in the resting position, which then immediately comes to lie on the contact area. The preparatory separation of the needle could take place because the distance of the closing component is smaller than the thickness of the needle. The preparatory needle selection then takes place by gravity.

Moreover, the separating device could comprise a monitoring sensor. The monitoring sensor could be arranged in the area, in which the ejection device with the separated needle exits from the receiving element, so that gripping devices of the fitting (insertion) device can pick up the needle. If no needle lies on the contact area of the separating device, a light beam, sent out, e.g., by the monitoring sensor, falls into empty space and a control signal of the monitoring sensor causes the operation of the lifting movement of the separating device to be automatically repeated. The monitoring sensor could also be present as a separate component and could interact with any moving device that brings about the movement of the ejection device. The monitoring sensor could, however, also be an integral component of the separating device or be provided as an additional component. A possible repetition of the lifting movement would take place without time loss for the fitting (insertion) device and the needle changer. In the needle fitting time of the fitting (insertion) device, the positioning of the needle can at any rate be achieved by means of the ejection device of the separating device even if a needle should fall down from the contact area. The ejection device with the separated needle lying on its contact area generally waits until the gripping devices of the fitting (insertion) device have to grasp this needle.

According to a further exemplary embodiment of the device according to the present invention, a vibration device could be associated with the receiving element. This vibration device could be used if it should happen that the needle falls down from the contact area of the separating device, and there is quasi a blank movement. When the vibration device then implements a vibration operation, this guarantees that the next movement operation of the ejection device with the needle takes place. The monitoring sensor and the vibration device could advantageously interact here. The device according to the present invention certainly has enough time to have available/prepare the needle in the above-described position for the gripping devices returning from the fitting operation.

For the forward transport of the receiving element with the needles and for the moving away of the emptied receiving element, contact elements could be provided that could be grasped by the gripping devices of the fitting (insertion) device. A receiving element change operation performed by a person is cost-effectively saved in this way.

With regard to a perfect interaction between the gripping devices of the fitting (insertion) device and the needle position, the position of the needle could be made more precise by means of a positioning device. This positioning device may have an additional positioning component for an axial positioning of the needle and/or a prepositioner for the rotated position of the needle and its crutch or crank.

Depending on the design of the contact area of the ejection device, it could happen that the needle is indeed separated and is arranged on or at the ejection device moved out of the receiving element; however, the needle tip and the crutch or crank protrude beyond the contact area. In this case, it could happen during each needle separation that the needle tip and the crutch or crank always go beyond the contact area of the ejection device differently. The result is that the gripping device always comes into contact with different sections of the needle.

In order to make possible a reproducible contact area of the needle, a press-on device, which carries out a displacement of the needle in the direction of its longitudinal axis and at the same time applies force to same in the case explained above, could be provided as an additional positioning component.

The press-on device could extend over the edge of the receiving element into the area of the ejection device, which has emerged from the receiving element, and, e.g., come into contact with the crutch or crank of the needle there and displace same on the contact area such that the defined position is reached. In the example explained, the contact area shall lie as close as possible to the crutch or crank. A pneumatic drive could be used to apply force and a purely translatory movement of the press-on device could be produced.

However, mechanical measures are also possible for achieving a pivoting movement in combination with an electric drive and further structural changes. Depending on the properties of the needle and of the gripper or depending on other structural conditions, an application of force, in addition or as an alternative to the application of force on the needle, could also take place on the contact area, the ejection device or the receiving element via the positioning component. In addition, directions of force other than those in the longitudinal direction of the needle may also be implemented. A prepositioner may be designed, e.g., as an ejector, which rotates the crutch or crank into a vertical position during the extension of the ejection device.

The device according to the present invention could be present as a mobile unit or be rigidly mounted in the area of the fitting (insertion) device/of the needle changer. A plurality of devices could be provided in the area of the fitting (insertion) device. This is the case if needle boards are fitted with different needles. For example, needle tips of various designs could be necessary over the entire needle board.

The fitting (or insertion) device could be a conventional semi-automatic or fully automatic needle-changing machine or a robot or a gripping jaw handled by a person.

There are now various possibilities to advantageously design and perfect the teaching of the present invention. For this, reference is to be made to the discussed embodiments and to the following explanation of an exemplary embodiment of the present invention based on the drawings. In conjunction with the explanation of the mentioned exemplary embodiment of the present invention, preferred embodiments and variants of the teaching are also explained in general. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is a schematic reduced representation of a cutout of the subject from FIG. 1 with insert for the receiving element as well as active monitoring sensor, in the resting position;

FIG. 3 is an enlarged, schematic top view of the receiving element from FIG. 2;

FIG. 4 is a schematic sectional representation along the sectional line A-A through the subject of FIG. 3;

FIG. 5 is an enlarged, schematic side view of the contact receiving element area of the separating device from FIG. 1;

DESCRIPTION OF THE PREFERRED EMBODIMENTS

Figure 1:
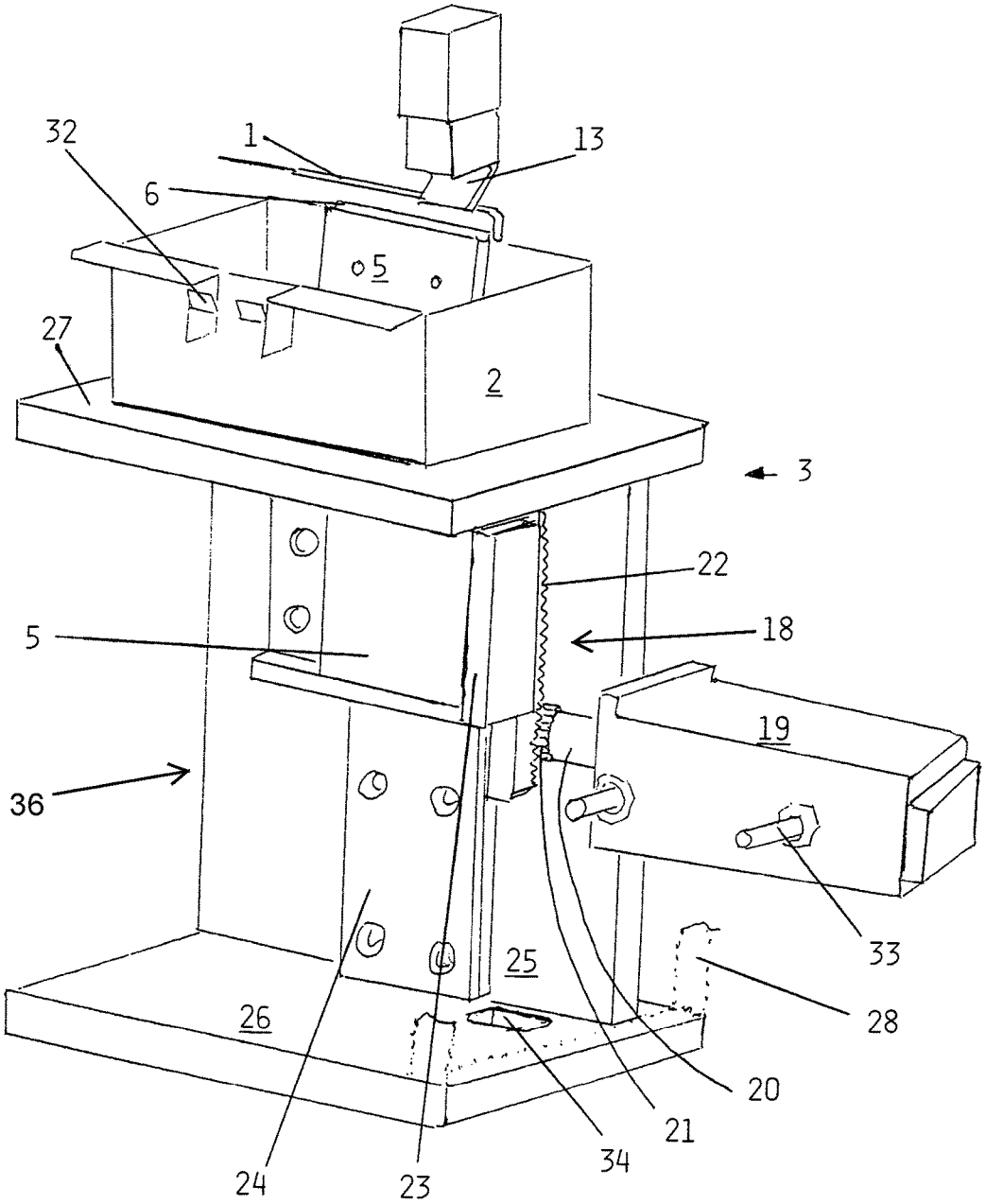
FIG. 1 is a schematic perspective view of a device according to the present invention with separating device and receiving element, in the operating position.
Figure 6:
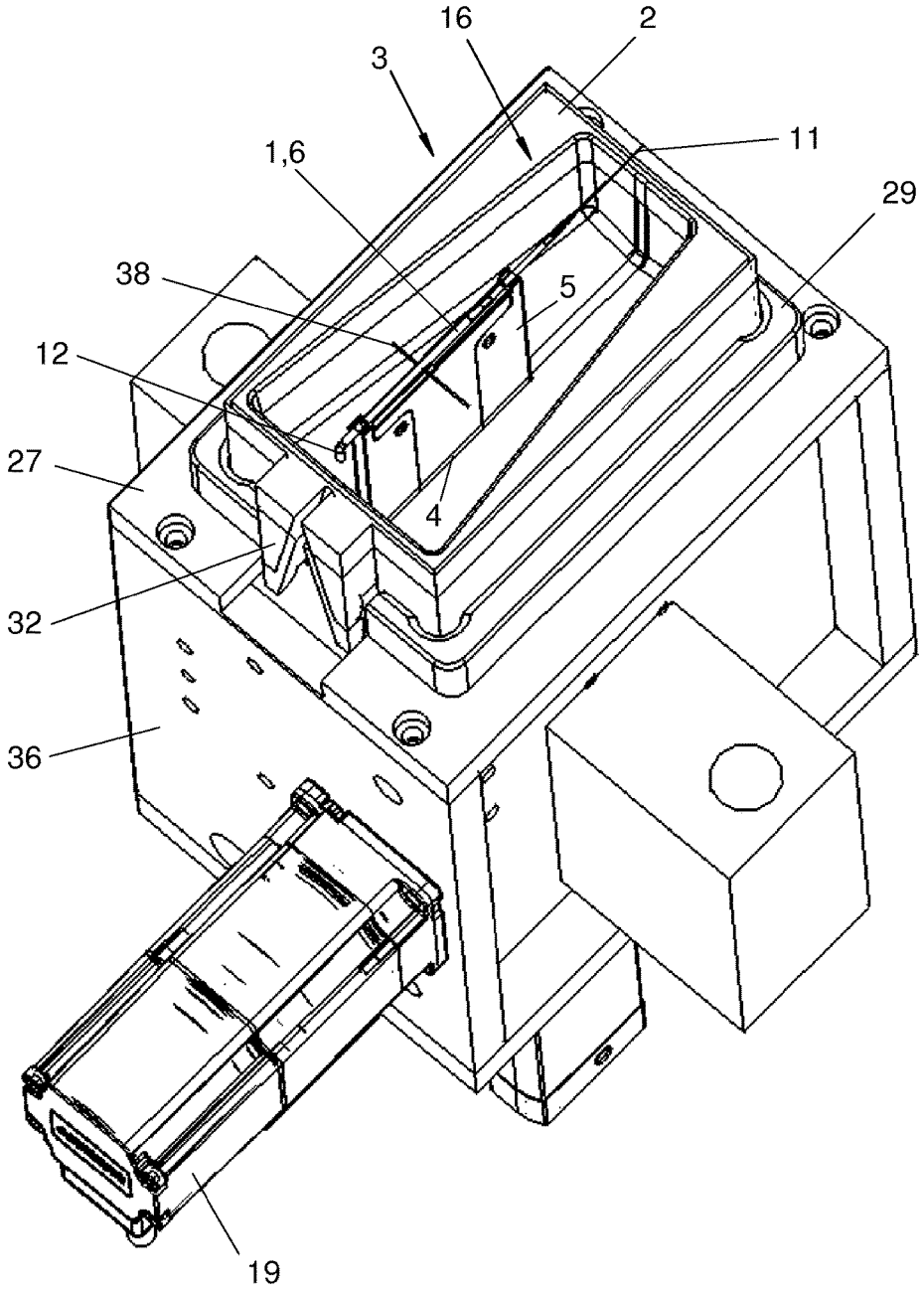
FIG. 6 is a perspective view showing a variant of the device of FIGS. 1 and 2 in the operating position.
Figure 7:
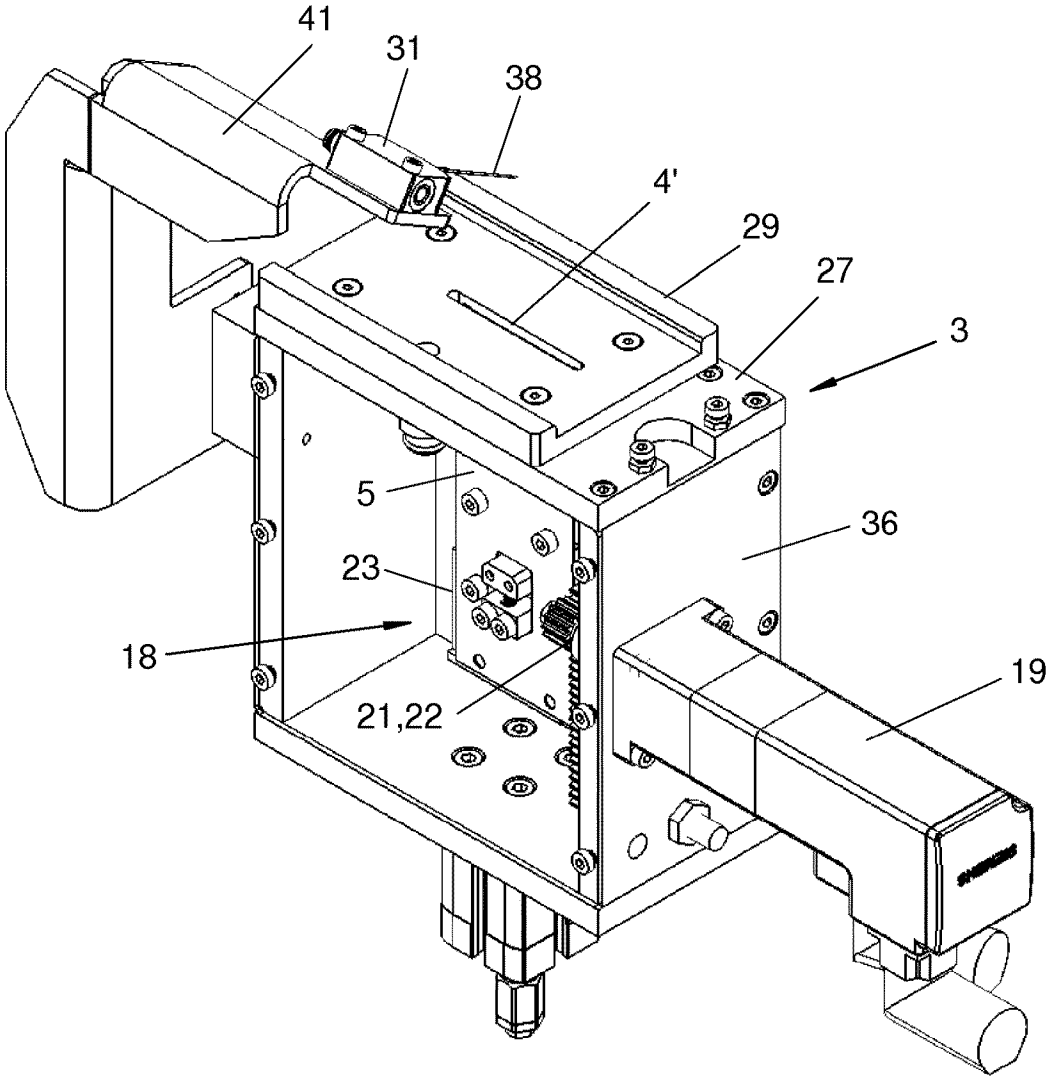
FIG. 7 is a perspective view of another variant to FIGS. 1 and 2 in the resting position.
Figure 8:
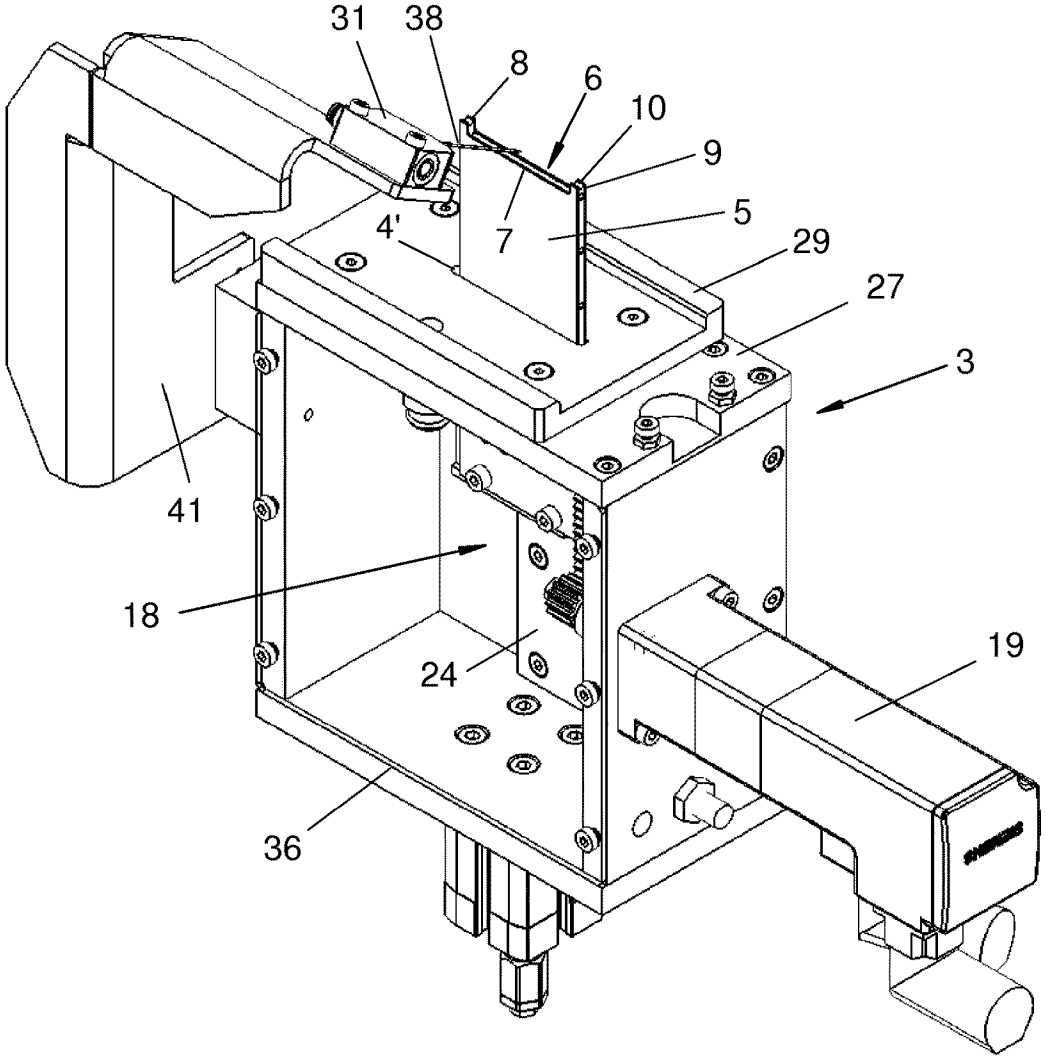
FIG. 8 is a perspective view of the variant of FIG. 7 in the operating position.

FIG. 1 shows a device for separating needles 1 for fitting a needle board of a needle machine for the manufacture of nonwoven fabric or needle felt, with a receiving element 2 for the needles 1 and with a separating device 3. FIGS. 6 through 8 show variants hereto.

In FIGS. 2 through 4, it is shown that the receiving element 2 has at least one through opening 4. The through opening 4 is shown in dotted line in FIG. 2. FIGS. 1 and 5 show that the separating device 3 according to the present invention comprises an ejection device 5, which can be passed through the through opening 4 of the receiving element 2 and which has a contact area 6, which here corresponds to a needle. The needle 1 is detected at the contact area 6. The receiving element 2 forms an integral unit together with the separating device 3 at least during the separation operation through the receiving element 2.

The ejection device 5 operates in the vertical direction V, from bottom to top, against gravity and ejects a needle 1, and all other needles, not shown here, are displaced in the receiving element 2. The contact area 6 has a carrying and guiding function with regard to a needle 1.

The contact area 6 is arranged at the upper front end of the ejection device 5 and is used for the targeted receiving and separating of a single needle 1 in the embodiments shown.

In the present exemplary embodiments, the ejection device 5 of the separating device 3 is designed as a blade, the contact area 6 of which comprises two supports 8, 9, spaced apart from one another and protruding upwards from the upper edge 7, with a groove 10 each. The spacing of the supports 8, 9 falls below the entire length LN of the needle 1, such that the needle tip 11 and the crutch or crank 12 protrude on both sides of the supports 8, 9. The entire length LA of the ejection device 5 makes up more than half of the entire length LN of the needle 1, such that the supports 8, 9 effectively rule out a tilting of the needle 1 about an imaginary axis of rotation in the transverse direction Q. The groove 10 counteracts a tilting of the needle 1 about imaginary axes of rotation in the vertical direction V and the longitudinal direction L. Because the supports 8, 9 protrude upwards, a free space 37 remains between the upper edge 7 of the ejection device 5 and the needle 1, into which the gripping device 13 of a fitting (insertion) device, not further shown, can easily extend for grasping the needle 1. Threaded holes on the ejection device 5, which make it possible to screw on a contact area 6 of a different design, are designated by 14.

FIGS. 3 and 4 show that the through opening 4 is provided in a base plate 15 of the receiving element 2. It is preferably arranged centrally on the base plate 15. As can be easily seen from FIGS. 1 and 2, the receiving element 2 is open at the top. FIG. 3 shows that the base plate 15 in the top view forms a trapezoid shape. The filled needles 1, not shown here, point in the receiving element 2 with their needle tips 11 to the tapering end of the trapezoid shape 16, and the crutches or cranks 12 point to the diverging end of the trapezoid shape 16. The needles 1, which are filled and uniformly preoriented with their needle tips 11 and crutches or cranks 12, are oriented essentially parallel in a pile (mass, bunch) of needles.

It is seen in FIG. 4 that the base plate 15, due to its shape, also forms a funnel 17, and that the through opening 4 is arranged in the deepest point of the receiving element 2 and of the funnel 17 and corresponds, in terms of its dimensions, to those of the contact area 6 of the ejection device 5.

The through opening 4 is thus shorter than the needles 1, which can consequently not fall out of the receiving element 2. In addition, the ejection device 5, in the extended position, closes the through opening 4. The through opening 4 is preferably arranged centrally on the base plate 15.

The receiving element 2 is designed, e.g., as a box-like container and has a shape which is adapted to the needle geometry and is preferably oblong. It can receive a supply of needles 1 with said heading along the container longitudinal axis. The interior space length of the receiving element 2 corresponds essentially to the needle length, which can ensure an axial prepositioning of the needles 1 at the ejection device 5 during a positioning of the receiving element 2.

The exemplary embodiment shown here provides—as is seen in FIG. 1—that the ejection device 5 is arranged below the receiving element 2. In addition, the separating device 3 comprises a lifting device 18 for moving the ejection device 5 with a drive 19 in the form of an electric motor, the drive shaft 20 of which carries a gear 21 as power transmission means, which meshes with another power transmission means in the form of a toothed rack 22. The toothed rack 22 is arranged at a carrier 23 for the ejection device 5, which is movable on a guide 24. In practice, the device according to the present invention is surrounded by a housing 36, of which only the rear wall 25, the base plate 26 and the cover plate 27 are illustrated and a side wall 28, against which the drive 19 is supported, is suggested as an example with dotted line. The cover plate 27 of the separating device 3 likewise has a through opening, not visible here, through which the ejection device 5 can extend.

FIG. 2 shows an expansion of the device according to FIG. 1 in the form of an insert 29, into which the receiving element 2 is inserted. The insert 29 also has a through opening 4', not visible here, through which the ejection device 5 can extend. The insert 29 comprises the receiving element 2 on the outside and is used for guiding and positioning the receiving element 2 on the separating device 3.

FIG. 2 also gives the impression of the housing 36 below the receiving element 2, since the closed front side 30 is also suggested there. The lifting device 18 is contained in the housing 36, and the drive is fixed to a side wall 28 with fastening means not shown here. Cable connections of the drive 19 are designated by 33.

While FIG. 1 shows the device according to the present invention in an operating position, and the ejection device 5 is in the maximum extended position and the gripper 13 has just removed the needle 1 from the contact area 6, FIG. 2 shows an empty receiving element 2, from which the last needle 1 has already been grasped by the gripper 13 and the ejection device 5 has already moved downwards with the carrier 23.

If needles 1 are still located in the receiving element 2, the contact area 6 of the ejection device 5 in the resting position closes the through opening 4 of the receiving element 2. Stops, which are not further shown here, and which make possible various positions of the ejection device on various height levels, are provided for this.

It is shown in FIG. 2 that the separating device 3 has a monitoring sensor 31. The dotted line shall suggest in a purely schematic manner the orientation of a laser beam 38 sent out from the monitoring sensor 31, which shall detect the area, in which the gripping device 13 picks up the needle 1 from the contact area 6 of the ejection device 5.

It is shown in FIGS. 1 and 2 that contact elements 32 are provided at the receiving element 2 in addition to the stabilizing device, which is connected thereto, points outwards and is not designated more specifically, which make possible a removal of an empty receiving element 2 and a regrasping of a new receiving element 2 by the gripping device 13 of a fitting (insertion) device. For the sake of simplicity, the contact elements 32 were omitted in FIGS. 3 and 4.

A recess in the base plate 26 of the device according to the present invention, which is used for fastening the separating device in the area of the fitting (insertion) device, is designated by 34.

By means of the device according to the present invention, it is possible for the fitting (insertion) device to find the needle 1 always in the same position by means of the known coordinates of the contact area 6 of the ejection device 5. Everything is set in such a way that the gripping device 13 can grasp onto the needle between the needle tip 11 and the crutch or crank 12. Precisely as a result of this, a robot as fitting (insertion) device is freed from the image processing and needle detection software and only still has to carry out the advancing to previously known positions and the grasping before the fitting operation at the needle board occurs. Due to the implementation of the separating operation within the receiving element 2, the device according to the present invention requires a very small size, precisely if the ejection device 5 and the components of the lifting device 18 are arranged below the receiving element 2.

FIG. 6 shows a variant of the device of FIGS. 1 through 4 in a perspective top view. The separating device 3 is essentially in agreement with the above-described exemplary embodiment. The variant of FIG. 6 differs by a different design of the insert 29 and of the contact element 32.

In this variant as well, the insert 29 encloses the container-like receiving element 2 in a ring-like manner on all outer sides and is used for guiding and positioning the receiving element 2 against the separating device 3 and its ejection device 5. In the variant of FIG. 6, the insert 29 is arranged opposite the cover plate 27 of the housing 36 in a vertically adjustable manner and makes possible a displacing of the receiving element 2 by means of a conveying device (not shown) on the cover plate 27 and along a conveying plane that is preferably flush with it. Consequently, the receiving element 2 can be automatically changed after emptying the pile (mass, bunch) of needles.

FIG. 6 illustrates, in addition, a different shape of a contact element 32 for the transport and the changing of the receiving element 2. The contact element 32 has here a wedge shape, which is favorable for a centering and transmission of force. Via this, a positive-locking connection can be established for transport purposes with said conveying device or, as in the first variant, with a gripping device 13 of a fitting (insertion) device. The ring-shaped insert 29 may be recessed in the area of the contact element 32 in the variant of FIG. 6.

FIGS. 7 and 8 show a further variant of the separating device 3 with a housing 36 shown open on the front side. The separating device 3 is designed here again corresponding to the first variant and has a, e.g., blade-like ejection device 5 with a lifting device 18 and a drive 19. FIGS. 7 and 8 also show the carrier 23 and the guide 24 as well as a toothed rack drive with power transmission means 21, 22.

FIG. 7 shows the separating device 3 in the resting position with lowered ejection device 5. FIG. 8 shows the extended operating position. For the sake of clarity, the needle 1 received at the contact area 6 is not shown. The contact area 6 has otherwise the same design as in FIG. 5 with upright supports 8, 9, which extend from an upper edge 7 of the ejection device 5 vertically upwards and have each a groove 10 on the top side for the positive-locking mounting of the needle shaft. The grooves 10 are spaced apart from the upper edge 7 to form said free space 37 and are flush with one another in the needle longitudinal direction.

FIGS. 7 and 8 show a different shape of the insert 29 and of the arrangement of the monitoring sensor 31. The receiving element 2 is not shown in FIGS. 7 and 8 for the sake of clarity.

The insert 29 is designed here in the form of a guide channel or a guide track for the receiving element 2. It has a bottom surface for supporting the receiving element 2 and one or more lateral guide elements for the receiving element 2. The insert 2 may likewise be connected to a conveying device (not shown) and permits an automatic changing of empty receiving elements 2. FIGS. 7 and 8 also show the through opening 4' at the insert 29 for the ejection device 5.

FIGS. 7 and 8 show the arrangement of a monitoring sensor 31, which detects the receiving element 2 in the extended operating position of the ejection device 5. As in the first exemplary embodiment, the monitoring sensor 31 may be designed as an optical sensor with a measuring beam 38, especially a laser beam. It may, as an alternative, have another suitable design. Preferably, the monitoring sensor 31 operates in a contactless manner. The monitoring sensor 31 is fastened to the housing 36 and positioned by means of a frame 41. The frame 41 has a shape that is suitable for the transport and changing of the receiving element 2.

Figure 9:
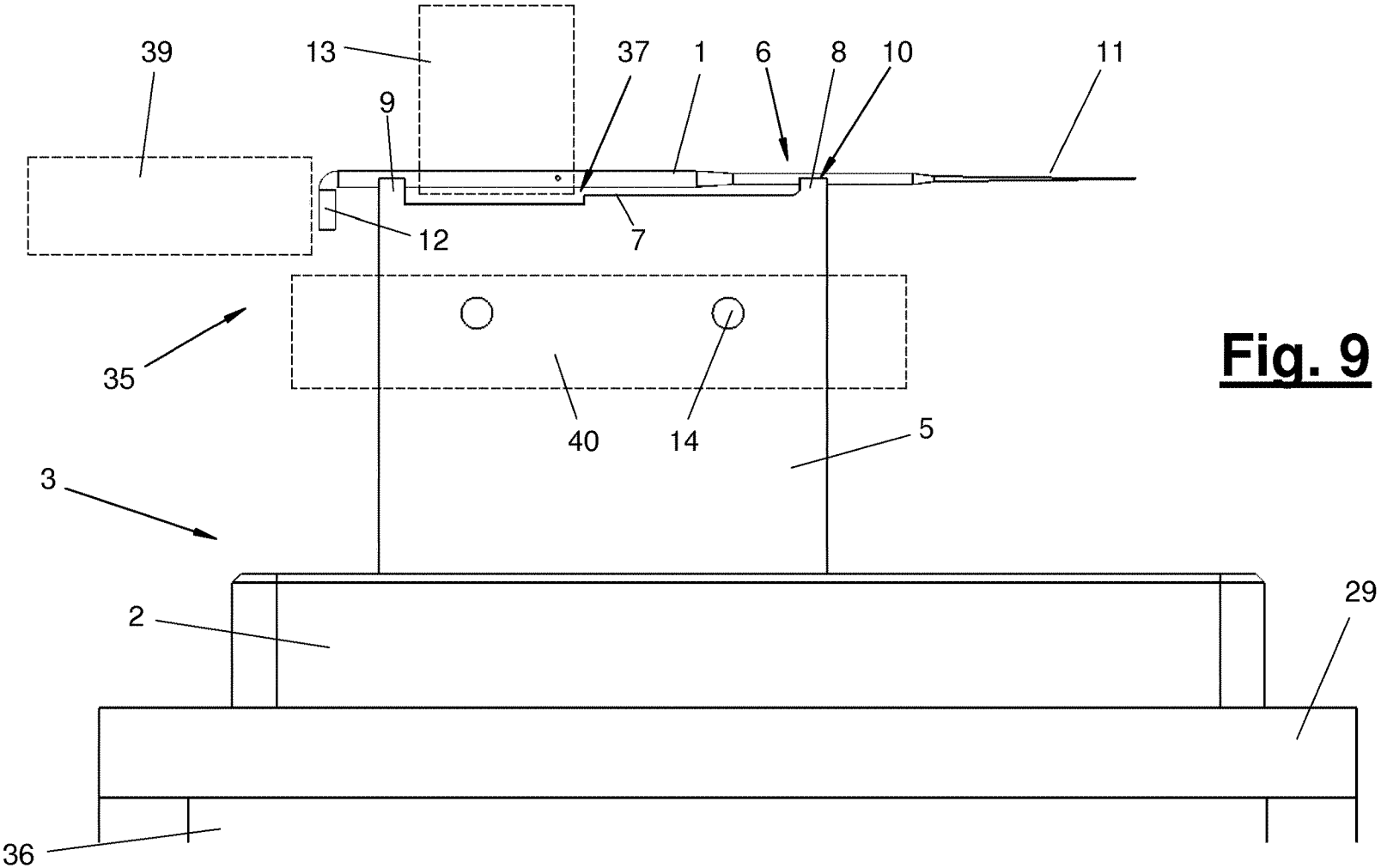
FIG. 9 is a broken-away side view of the separating device with a positioning device and a gripper.

FIG. 9 schematically shows a side view of the separating device 3 and of the ejection device 5 in the extended operating position corresponding to FIG. 5. In addition, parts of the receiving element 2 and of the insert 29 as well as the housing 36 are shown.

FIG. 9 illustrates, moreover, the design of the contact area 6 and of the free space 37 formed between the upper edge 7 of the ejection device 5 and the received needle 1. The upper edge 7 may have a graduated shape for this. In the area of the gripping device 13, shown in dotted line, the free space 37 may be enlarged by a local lowering of the upper edge 7.

Moreover, FIG. 9 schematically shows a positioning device 35, which is provided for the needle 1 received at the contact area 6 and for its alignment. The positioning device 35 may have a one-piece or multi-piece design. It may carry out one or more alignments of the needle 1.

The positioning device 35 has for this, e.g., the positioning component 39 mentioned in the introduction, which carries out a positioning of the needle 1 in its longitudinal direction relative to the contact area 6. The positioning component 39 may be designed, e.g., as a pusher and act on the rearward crutch or crank 12 and move, especially push, same into a preset axial position. Consequently, the needle 1 equipped with a contoured shaft according to FIG. 9 comes into a defined axial position opposite the gripping device 13.

The positioning device 35 may, further, have a prepositioner 40, which is also shown schematically and in dotted line. The prepositioner 40 may ensure a rotary orientation of the needle 1 received at the contact area 6, and the crutch or crank 12 is brought into a defined rotary position. In this case, it may be oriented, e.g., vertically and downwards. The prepositioner 40 may be formed, e.g., by ejection brushes, which rotate a crutch or crank 12, which is possibly sloped and acting as a stop, into the desired position during the extension movement of the ejection device 5. At the same time, they may check and secure the position of the needle 1 on the contact area 6. As an alternative, the prepositioner 40 may be designed and also arranged in a different way in terms of construction. It may possibly also be omitted.

Figure 10:
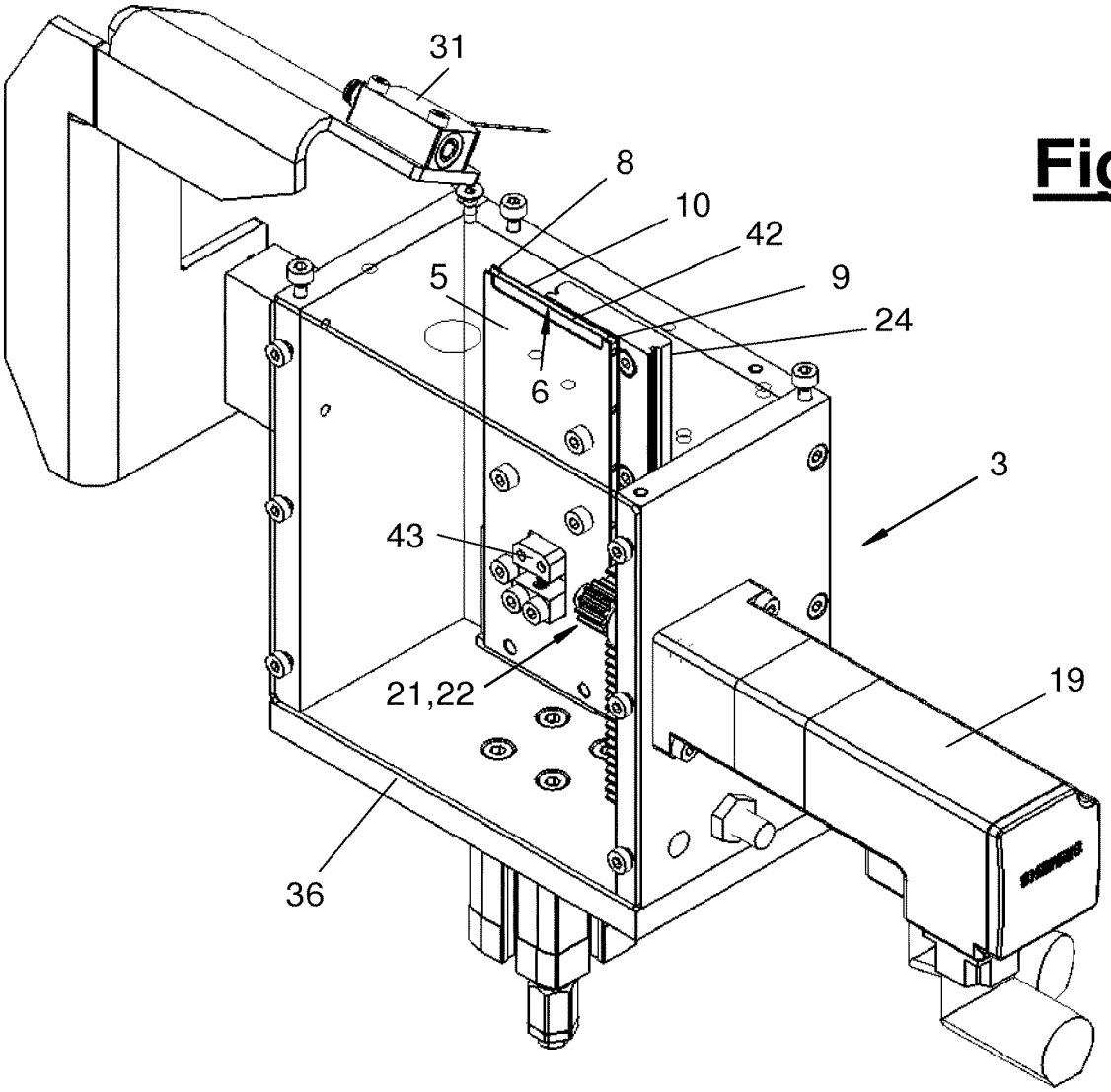
FIG. 10 is a perspective view of a variant of the device of FIGS. 1 through 9.
Figure 11:
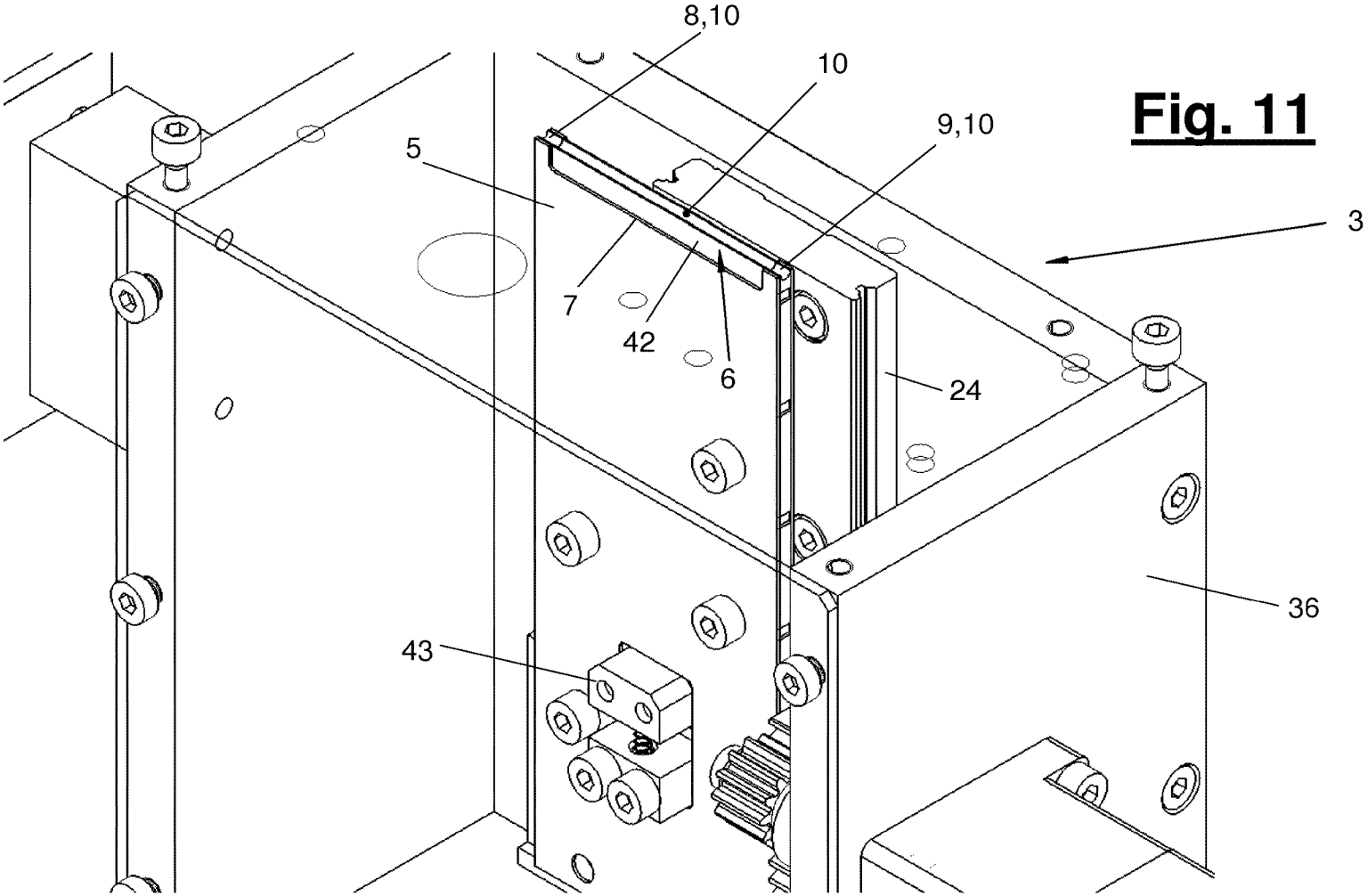
FIG. 11 is a perspective enlarged view of a variant of FIG. 10.
Figure 12:
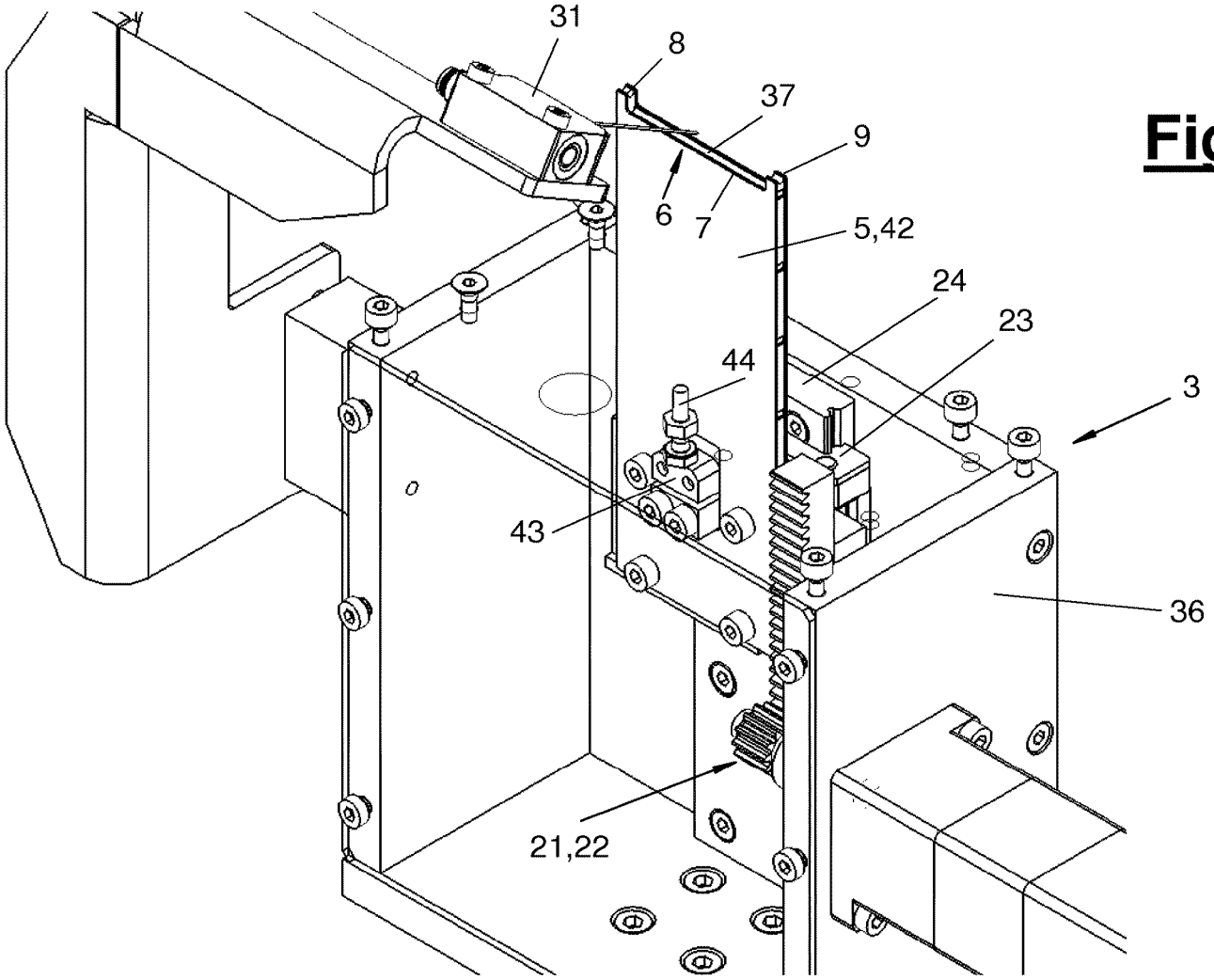
FIG. 12 is another perspective enlarged view of a variant of FIG. 10.

FIGS. 10 through 12 show a variant of the device of FIGS. 1 through 9 in various operating positions. The separating device 3 is in agreement in terms of basic design with the exemplary embodiments of FIGS. 1 through 9. It has a housing 36 with an ejection device 5 and a drive 19 in addition to power transmission means 21, 22 as well as a carrier 23 and a guide 24. Likewise, the monitoring sensor 31 may also be present. FIGS. 10 through 12 show the housing 36 open, and the cover plate and the front wall are not shown or are shown transparently.

The difference to the first-mentioned exemplary embodiments is in the different design of the ejection device 5, of the contact area 6 and of the groove 10 there. FIGS. 10 and 11 show the ejection device 5 in a resting or initial position, before it dips into the receiving element 2 and the pile (mass, bunch) of needles, which are not shown in FIGS. 10 through 12 for the sake of clarity. FIG. 12 shows the extended operating position of the ejection device 5, in which a gripper can grasp the separated needle (not shown).

The ejection device 5 is provided with an insert 42, which is arranged movably in relation to the ejection device 5, and which has a longitudinal groove 10 on its upper edge. The insert 42 may be mounted and guided in or on the ejection device 5. The ejection device 5 is, in the embodiment being shown, again designed as a plate-like blade and has a box shape that is hollow and open on the top side. The above-described upright supports 8, 9, with a groove 10 each on the top side, are arranged at the upper ends of the ejection device 5 and at the contact area 6 there. The insert 42 is located between the supports 8, 9 and arranged in the hollow interior space of the box-like ejection device 5.

The insert 42 may be adjusted along the ejection device 5 and in the direction of the movement of extension. For this purpose, an actuator 43 is provided which utilizes and implements the extension movement of the ejection device 5 for an adjusting movement of the insert 42, and it interacts with the stop 44 fixed to the housing, which is shown in FIG. 12.

The groove 10 at the insert 42 is likewise provided and designed for detecting and positioning a single needle 1. The groove 10 may have the same cross-sectional geometry as the grooves 10 at the supports 8, 9.

At the beginning of the extension operation, in particular in said resting position and when the ejection device 5 dips into the receiving element 2 and the pile (mass, bunch) of needles there, the insert 42 is in an upper position, in which its groove 10 adjoins the grooves 10 of the supports 8, 9 in a flush manner on both sides. A long continuous groove 10, which is especially favorable for detecting and separating a needle 1, is consequently formed in the contact area 6. FIG. 10 and the detail view of FIG. 11 illustrate this position.

FIG. 12 shows the extended operating position of the ejection device 5. In this operating position the insert 42 is removed from the contact area 6, as a result of which only short groove sections 10 are still present at the supports 8, 9 and the free space 37 is formed in the area between them. The insert 42 is lowered or retracted in the box-like ejection device 5 for this purpose.

This retracted movement is brought about by the actuator 43. As FIG. 11 illustrates in the enlarged view, the actuator 43 has two flanges arranged at a distance above one another, between which a compression spring is arranged. The lower flange is connected to the ejection device 5, in particular to the blade.

The upper flange is connected to the insert 42. It stops before reaching the extended operating position at the stop 44, and the insert 42 stops and the ejection device 5 is moved further upwards. Consequently, a relative lowering movement is produced for the insert 42, and the spring is also compressed between the flanges. During the subsequent downward movement of the ejection device 5, the actuator 43 comes free from the stop 44, and the insert 42 is again extended or raised under the action of the flange spring and assumes the position shown in FIGS. 10 and 11.

As for further features not shown in the figures, reference is made to the general section of the specification.

Finally, it should be pointed out that the teaching according to the present invention is not limited to the exemplary embodiments explained above. Rather, other embodiments of the ejection device 5 and of its contact area 6 as well as of the receiving element 2 are possible. In addition, the structural means for achieving the movement of the ejection device may vary and are freely selectable.

While specific embodiments of the invention have been shown and described in detail to illustrate the application of the principles of the invention, it will be understood that the invention may be embodied otherwise without departing from such principles.

The invention claimed is:

1. A device for separating needles or a fitting of a needle board of a needle machine for the manufacture of nonwoven fabric or needle felt, the device comprising:
- a needle mass receiving element for receiving a mass of the needles, the needle mass receiving element having at least one through opening; and
- a separating device comprising an ejection device which passes through the through opening of the needle mass receiving element, and which has a needle contact area that is configured to a contour of at least one needle, wherein the contact area of the ejection device has two supports, which are spaced apart and project upwards, each comprising a groove for receiving a needle of the mass of the needles.

2. A device in accordance with claim 1, further comprising a gripping device, wherein a free space is formed for the gripping device between an upper edge of the ejection device and the needle which can be received by the contact area.

3. A device in accordance with claim 1, wherein the ejection device comprises a blade having an insert with an insert upper groove arranged movably between the supports.

4. A device in accordance with claim 3, wherein the insert has an actuator activated by extending the ejection device.

5. A device in accordance with claim 3, wherein the insert is arranged at a level of the supports with the insert groove adjoining the groove of each of the supports in a resting position and during extension of the ejection device and the insert is lowered in an extended operating position of the ejection device, forming a free space.

6. A device in accordance with claim 1, wherein:
- the through opening is provided in a base plate of the needle mass receiving element and the needle mass receiving element is open at the top; and
- an interior space of the needle mass receiving element has a funnel-shaped design.

7. A device in accordance with claim 1, wherein the through opening is arranged in a deepest point of the needle mass receiving element and corresponds, with regard to opening dimensions, to dimensions of the contact area of the ejection device and the ejection device is arranged below the needle mass receiving element.

8. A device in accordance with claim 1, wherein a length of the ejection device contact area, and of the through opening, are shorter than an entire length of the needle.

9. A device in accordance with claim 1, wherein the contact area of the ejection device in a resting position closes the through opening of the needle mass receiving element.

10. A device in accordance with claim 1, the separating device comprises a lifting device for moving the ejection device against gravity.

11. A device in accordance with claim 10, further comprising a drive, wherein:
- the lifting device comprises a power transmission means, a guide and a carrier displaceable on the guide for the ejection device; and
- the carrier interacts with the power transmission means.

12. A device in accordance with claim 1, wherein:
- the separating device comprises a monitoring sensor; and
- the monitoring sensor detects the contact area of the ejection device in an extended operating position and the received needle.

13. A device in accordance with claim 1, wherein the needle mass receiving element comprises a vibration device.

14. A device in accordance with claim 1, wherein contact elements are provided on the needle mass receiving element for changing the needle mass receiving element.

15. A device in accordance with claim 1, wherein the separating device has a positioning device for positioning the needle which can be received at the contact area.

16. A device in accordance with claim 15, wherein the positioning device has a positioning component comprising a press-on device, which applies force to at least one of the needle which can be received in the contact area and the contact area and the ejection device and the needle mass receiving element for optimizing a position of the needle in a longitudinal direction of the needle.

17. A device in accordance with claim 15, wherein the positioning device has a prepositioner for rotating the needle about the longitudinal axis and for aligning a needle crutch or crank.

18. A device for separating needles for a fitting of a needle board of a needle machine for the manufacture of nonwoven fabric or needle felt, the device comprising:
- a needle mass receiving element for receiving a mass of the needles, the needle mass receiving element having at least one through opening; and
- a separating device comprising an ejection device, which passes through the through opening of the needle mass receiving element, and which has a needle contact area that corresponds to a needle, wherein:
- the contact area is arranged at an upper front end of the ejection device and is configured for a targeted receipt of a single needle and a separation of a single needle of the mass of the needles from other needles of the mass of the needles, whereby the contact area defines a single needle carrying and guiding means for carrying and guiding a single received needle; and
- the ejection device operates in a vertical direction, from a bottom to a top, moving against gravity and ejects the single received needle of the mass of the needles, and all other needles of the of the mass of the needles are displaced in the receiving element.

19. A device in accordance with claim 18, wherein the ejection device of the separating device is configured as a blade, punch or plunger.

20. A device in accordance with claim 18, wherein the contact area of the ejection device comprises at least one groove for the received needle of the mass of the needles.

21. A device in accordance with claim 18, wherein:

the contact area of the ejection device has two supports, which are spaced apart and project upwards, each comprising a groove for a receiving the received needle of the mass of the needles;

the ejection device comprises a blade having an insert with an upper insert groove arranged movably between the supports;

the insert is arranged at the level of the supports with the insert groove adjoining a groove of each of the supports in a resting position and during extension of the ejection device and the insert is lowered in an extended operating position of the ejection device, forming a free space.

22. A device in accordance with claim 21, wherein the insert has an actuator activated by the extension of the ejection device.

23. A device in accordance with claim 18, wherein:

the through opening is arranged in a deepest region of the needle mass receiving element and corresponds, with regard opening dimensions, to dimensions of the contact area of the ejection device;

the ejection device is arranged below the needle mass receiving element; and the contact area of the ejection device in a resting position closes the through opening of the needle mass receiving element.

24. A device in accordance with claim 18, further comprising a drive, wherein:

the separating device comprises a lifting device for moving the ejection device against gravity;

the lifting device comprises a power transmission means, a guide and a carrier displaceable on the guide for the ejection device; and the carrier interacts with the power transmission means.

25. A device in accordance with claim 18, wherein the separating device comprises a monitoring sensor, wherein the monitoring sensor detects the contact area of the ejection device in an extended operating position and detects the received needle.

* * * * *